US006279625B1

(12) United States Patent
Ludwig

(10) Patent No.: US 6,279,625 B1
(45) Date of Patent: Aug. 28, 2001

(54) FILLER VALVE FOR LIQUIDS CONTAINING FIBERS

(75) Inventor: Werner Ludwig, Darmstadt-Wixhausen (DE)

(73) Assignee: Tetra Lavel Holdings & Finance S.A., Pully (CH)

( * ) Notice: Subject to any disclaimer, the term of this patent is extended or adjusted under 35 U.S.C. 154(b) by 0 days.

(21) Appl. No.: 09/600,923

(22) PCT Filed: Oct. 23, 1998

(86) PCT No.: PCT/EP98/06739

§ 371 Date: Jul. 24, 2000

§ 102(e) Date: Jul. 24, 2000

(87) PCT Pub. No.: WO99/37543

PCT Pub. Date: Jul. 29, 1999

(30) Foreign Application Priority Data

Jan. 24, 1998 (DE) ..... 198 02 692

(51) Int. Cl.[7] ..... B65B 1/04

(52) U.S. Cl. ..... 141/301; 141/310; 141/67

(58) Field of Search ..... 141/301, 302, 141/286, 285, 290, 307, 309, 310, 59, 67; 222/504, 509, 518

(56) References Cited

U.S. PATENT DOCUMENTS

| | | | |
|---|---|---|---|
| 936,792 | * 10/1909 | Merritt . | |
| 4,243,160 | 1/1981 | Reil . | |
| 5,145,008 | * 9/1992 | Yun | 141/39 |
| 5,586,576 | 12/1996 | Franke et al. . | |
| 5,664,487 | 9/1997 | Kaneko . | |

FOREIGN PATENT DOCUMENTS

| | | |
|---|---|---|
| 39350 | 8/1965 | (DE) . |
| 2 321 205 | 11/1974 | (DE) . |
| 8507345 | 7/1985 | (DE) . |
| 44 11 629 | 11/1995 | (DE) . |
| 0 389 065 | 9/1990 | (EP) . |
| 2 288 220 | 10/1995 | (GB) . |

* cited by examiner

*Primary Examiner*—Steven O. Douglas
(74) *Attorney, Agent, or Firm*—Burns, Doane, Swecker & Mathis, L.L.P.

(57) ABSTRACT

A valve is described for the dosaged filling of fluids in packages, with a housing (1) with feed pipe (24), a mouthpiece (2) on the front face and an outlet device (14), with a closure body (3) able to be driven movably in the housing (1), able to be brought into engagement with a valve seat and having at the front a valve cone (32) and there behind a thickened central part, and with rear sealing devices (5). So that both fluids similar to water and also those with a fibre content can be filled in a dosaged manner without the risk of clogging and at the same time without relative movements between packaging and outlet device (14) a fluid jet with little to no included air is achieved at a low outlet speed, provision is made according to the invention that the thickened central part (36) of the closure body (3) is provided on its peripheral region with a ring of flow ducts (37, 38) extending in the direction of the longitudinal axis of the mouthpiece (2) which, being open toward the front and toward the rear open into the interior (46, 47) formed by the housing (1).

10 Claims, 7 Drawing Sheets

(V-V)

VII - VII

FILLER VALVE FOR LIQUIDS CONTAINING FIBERS

Figure 1:
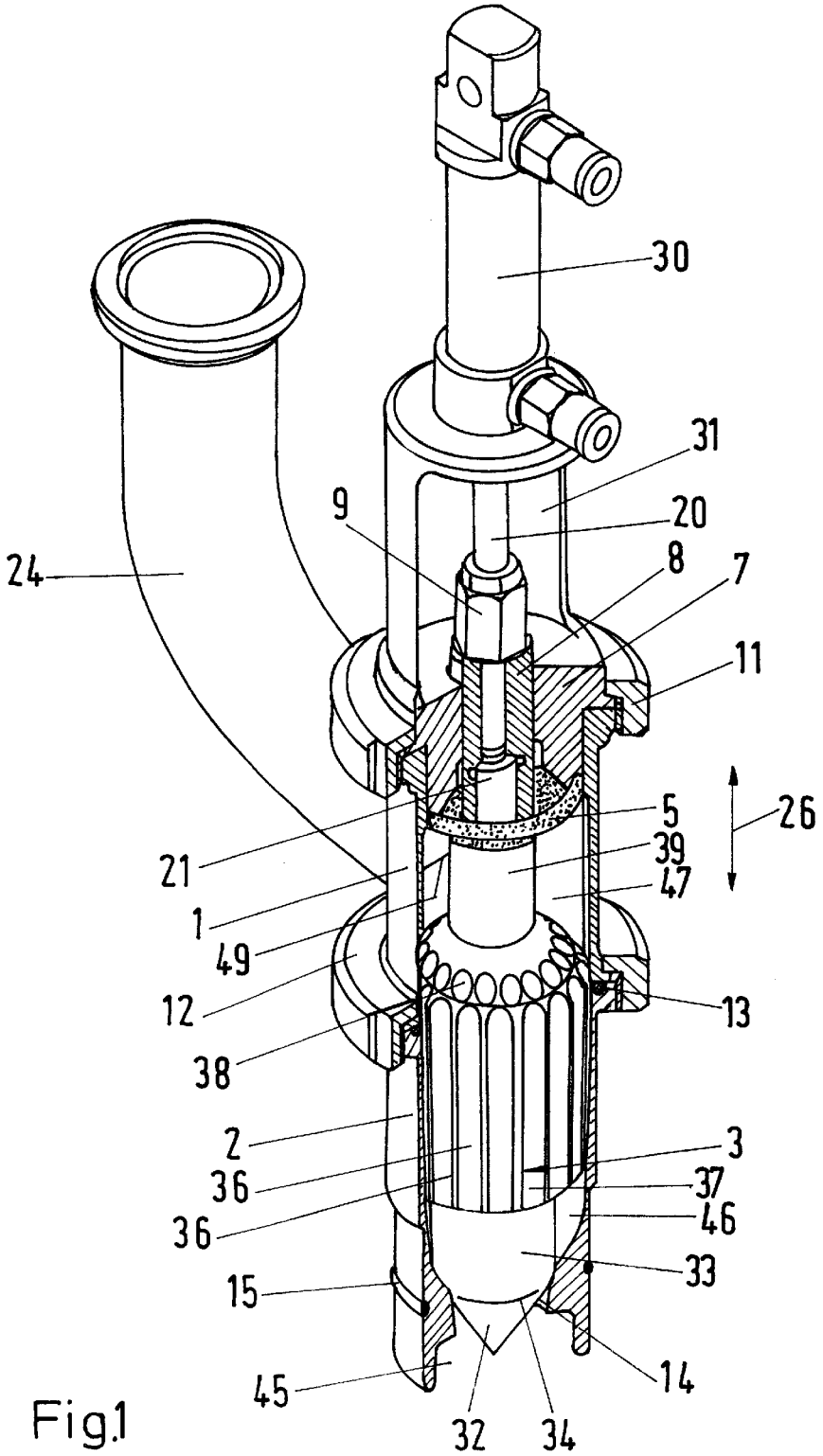

This application claims priority under 35 U.S.C. §§119 and/or 365 to application No. PCT/EP98/06739 filed in WIPO on Oct. 23, 1998, and to application No. 198 02 692.7 filed in Germany on Jan. 24, 1998; the entire contents of which are hereby incorporated by reference.

The invention relates to a valve for the dosaged filling of fluids in packages, with a housing having a feed pipe, a mouthpiece on the front face and an outlet device, with a closure body driven movably in the housing, able to be brought into engagement with a valve seat and having at the front a valve cone and a thickened central part there behind, and with rear sealing devices.

Fluids of various types, in particular in the field of foodstuffs, are filled in packages in large quantities. Valves or dosaging valves used for this have a housing in which a closure body, which has the fluid to be filled flowing to it from behind via the feed pipe continuously, is moved intermittently back toward the rear, in order to open the valve, and is pressed toward the front again in order to close the valve.

A known valve according to the introductory features achieves the outflow of the fluid filling material at a small outlet speed with sufficiently large filling quantities, so that for example when milk is being filled an undesirably great foam formation in the packaging is avoided. The known filling valve also fulfils a further condition that in fact after the valve is closed an undesired dripping of the fluid is prevented. For this, meshes were arranged earlier at the end of the dosaging valve at the outlet side, whilst the known valve described in the introduction has an outlet plate at the end of the mouthpiece on the outlet side, in which outlet plate bores are arranged running in the direction of the longitudinal axis of the mouthpiece and arranged parallel to each other, with the formation of outlet holes, the diameter of which lies between 1 mm and 5 mm. To the rear of the outlet plate, i.e. upstream thereof there is a space up to the valve cone of the closure body, in which the fluid which is to be filled is held back on closure of the known valve inter alia by the surface tension, so that there is no dripping.

Disadvantageously, the outlet holes in the outlet plate of the known valve become obstructed when fluids with a small fibre content are to be filled. This frequently occurs during the filling of fruit juices which, known to the manufacturer, are to to remain mixed with fibre pieces and other small particles. The known valve therefore does not allow fruit juices or the like to be filled. If one were now to enlarge the outlet openings in the known valve, in order to reduce the risk of clogging, then the fluid would no longer hold in the described space to the rear of the outlet plate after closure of the valve, and the undesired dripping would disadvantageously result. If only one outlet hole or for instance even several outlet holes have become clogged, then the filling accuracy of the known valve suffers with further disadvantage.

Apart from the susceptibility of the known valve with respect to particles or fruit fibres in the fluids, disadvantageously the flow jet of the known valve is frequently unsteady and has too great a surface roughness, so that the jet entering into the packaging entrains too much air laterally. Through the geometry of the known valve, the filling material jet disadvantageously contains in addition a radial flow component by which likewise the emerging jet becomes unsteady.

It is therefore an object of the invention to construct the valve of the type initially mentioned such that both fluids similar to water and also those with a fibre content can be filled in a dosaged manner without the risk of clogging, and at the same time without relative movements between the packaging and the outlet device a fluid jet is achieved with little to no enclosed air at a low outlet speed.

This problem is solved according to the invention in that the thickened central part of the closure body is provided on its peripheral region with a ring of flow ducts extending in the direction of the longitudinal axis of the mouthpiece, which ducts open to the front and to the rear in an open manner into the interior which is formed by the housing. The closure body operates as in the known case with opening and closing of the valve in that the valve cone is raised from its seat or is pressed against the seat. Quite differently from in the known valve, however, the flow ducts are situated in this intermittently moving closure body, namely in the peripheral region of its thickened central part. Towards the outlet side, the new valve is open, i.e. there is no longer a mesh surface or an outlet plate, as was previously regarded as essential, in order to prevent a dripping. According to the invention, a dripping is largely also prevented without the action of a surface tension on the fluid under the valve seat, and preferably the space beneath or in front of the valve seat is constructed to be as small as possible and a reduction or an elimination of the undesired dripping is established.

Through the flow ducts extending in the direction of the longitudinal axis of the mouthpiece, the radial component of the inflowing fluid is converted into a laminar flow in the flow ducts, so that the emerging fluid jet is so calmed that almost no air is included in the jet and hence could be entrained into the fluid. Also in the new valve, the dosaged filling of the fluid is successful without the outlet side of the valve having to be immersed into the packaging. With a large quantity, the emerging fluid jet has a low base speed, and through the small wetted surface under or in front of the valve seat, dripping is minimized, although the valve cone which is arranged at the front remains surrounded by an annular wall so that no spraying occurs when the valve is closed.

Furthermore, it is advantageous according to the invention if the closure body has a front cylinder between the valve cone at the front and the central part, and also has a rear cylinder between the central part and the rear sealing devices. The diameters of the front and rear cylinders are preferably smaller than that of the thickened central part. Thereby, in connection with the side walls of the housing approximately in the form of cylinder covering surfaces, spaces are provided in front of and behind the thickened central part, in which the fluid can move in the way it is forced to move by the geometry of the valve. On the inlet side therefore the fluid can be moved behind the feed pipe in a spiral form into the space behind the thickened central part, in order to then enter into the flow ducts. In the space around the front cylinder, which is approximately an annular space, the fluid can be passed on gently, so that the flow can become calm to a certain extent. In this way a desired effect can be exerted onto the fluid flowing through in succession, such as for example the collecting- and deflecting effect in the space to the rear of the thickened central part, the laminating effect of the flow ducts in the space in the region of the thickened central part and the calming in the front space in front of the thickened central part. In so doing, the feed pipe is applied laterally, so that the closure body can perform its movement stroke directly in the outflow direction, i.e. in the direction of the longitudinal axis of the mouthpiece.

Down to the above-mentioned annular spaces in front of and behind the thickened part of the closure body, the closure body largely fills the approximately cylindrical interior of the housing. The diameters of the flow ducts are large compared with the outlet openings of known valves, and amount to twice to ten times, preferably three to six times. Thereby, a clogging of the individual flow ducts by fibres or particles contained in the fluid which is to be filled is practically ruled out.

In addition, it is favourable according to the invention if the flow ducts are formed by externally radially open flow grooves arranged on the periphery of the central part of the closure body, and/or radially closed ports. The valve according to the invention operates both with flow ducts only in the form of externally radially open flow grooves; and with a different embodiment one likewise achieves good results with a valve, the flow ducts of which are only formed by radially closed ports. Of course, the new valve operates best when one provides both types of flow ducts at the same time and arranged adjacent to each other. Thus, for example, the radially closed ports can be arranged at a small radial distance from the outer periphery of the central part and the radially externally open flow grooves can be constructed respectively between two ports directly on the peripheral surface. If one provides both the ring of ports and also that of flow grooves simultaneously, then one achieves optimum opening surfaces in relation to the cross-section which is available. The cross-sectional area which is to be flowed through then lies on a very small space in the region of these described rings, creating a large passage cross-section for the fluid which is to be filled. If one chooses as an example the embodiment in which only the flow grooves are used, then these can be constructed so deep, i.e. with so great a radial depth measurement, that a type of scoop or wing is produced between two grooves respectively.

The flow ducts in the peripheral region of the closure body act like a laminator. The length of the thickened central part of the valve body can be understood to be a laminator. This laminator eliminates practically every radial component in the flow of the fluid moving through the flow ducts.

It has already been stated above that through the lateral supply of the fluid which is to be filled into the dosaging valve, a radial component automatically occurs in the region around the rear cylinder. If one were not to eliminate this radial component to the greatest extent, then the jet of the fluid emerging from the valve and entering into the packaging would split and on falling into the packaging, air would be entrained into the fluid. In the case of milk or other sensitive fluids, this would lead to the formation of foam with the known disadvantages resulting therefrom. It has been established in addition that a jet falling approximately vertically downwards is mixed with considerably more air if the fluid jet were to have a rougher surface and a greater cross-sectional area. Both, however, is promoted by a radial component which may be present in the flow. The laminator eliminates this radial component according to the invention and therefore makes possible a flow jet of smaller cross-sectional area and smoother surface.

The essential part of the invention is this laminator by which it is permitted to fill both fluids similar to water and also those with a fibre content or other solids. Through the relatively large diameters of the flow ducts compared with the filling valves hitherto, not only is a clogging is avoided, but also for the reasons explained above the formation of a largely air-free fluid jet with a smooth surface is successful.

The invention is in addition advantageously characterized in that the sealing surface situated in the transition region between valve cone and front cylinder is able to be brought into engagement with the valve seat in the mouthpiece, and the valve cone projects into a free space between the valve seat and the front outer edge of the mouthpiece. The closure body has from front to back or in the generally conventional vertical arrangement of the valve in the filling machines from bottom to top (contrary to the flow direction) behind the valve cone the front cylinder, behind it the central part and behind the latter the rear cylinder. The valve cone widens up to a surface in the shape of a circular ring, which represents the sealing surface of the closure body. Through the vertical up— and down movement or the intermittent movement of the closure body to the front and to the rear, this sealing surface is brought into engagement with the valve seat in the mouthpiece or out of engagement from the valve seat. This step is in fact also usual in other known valves with a valve cone. According to the invention, however, the valve cone now projects on the downstream side or at the front in front of the valve seat into a free space. This space is situated between the valve seat and a front outer edge of the mouthpiece. In this free space, with the valve according to the invention, the fluid can flow off without substantial throttling effects. This was not the case in the older valves because in these at the outermost end a mesh, a perforated plate or the like was always arranged. Through the steps according to the invention, on the other hand, the teaching is given that the fluid which is to be filled only undergoes a treatment in the flow ducts, i.e. only in the laminator, in which in fact the radial component of the flow is eliminated. As soon as the fluid leaves the flow ducts, it arrives into a substantially free interior, in which the outflow can take place in an unimpeded manner. This outflow therefore begins already—with the valve opened—in the space adjacent to the front cylinder and then continues via the valve seat to the front or below into the free space.

Between the surface of the valve cone internally and the valve seat externally, the actual outlet surface of the dosaging valve according to the invention is formed. The size of this annular surface determines the passage cross-section and hence the quantity of fluid flowing per unit of time. As can be seen, the desire exists to construct this passage cross-section so as to be as large as possible, in order to achieve the least possible outlet speed for a large fluid volume. The steps according to the invention here achieve excellent results compared with known valves.

The free space in the region of the front end of the mouthpiece under or in front of the valve sat is expediently kept small according to the invention. Then in fact the dripping becomes negligibly small or is even eliminated. When the fluid, after flowing past the valve seat, in any case does not need to undergo any further influencing, then this free space can be constructed so as to be short viewed in longitudinal direction of the mouthpiece. The shorter the annular outer wall, the smaller this free space. To avoid uncontrolled spraying of the fluid outwards on closing of the valve, of course the wall of the mouthpiece at the front and hence the length of the free space can not be made short as desired. However, an optimization is successful as soon as the spraying is eliminated. The free space does not then need to be constructed larger, and its inner surfaces can even be coated with a material or produced from such a material, with which the fluids concerned run off very quickly. Then in fact no drops can form and the dripping stops.

It is, in addition, favourable if according to the invention the free space between the valve seat and the front outer edge of the mouthpiece in its rear region which lies on a quarter to two thirds of the axial length in front of the valve seat, is formed by a surface which is constructed so as to be crowned in cross-section. In other words, the free space is divided into a crowned part which takes up a quarter to two thirds of the total length and an approximately cylindrical part which takes up the remaining part of the axial length of this free space between the valve seat and the outer edge of the mouthpiece. The crowned rear region of the free space widens in cross-section from a smaller internal angle á to a larger outer angle á. Whereas the latter only serves for a better introduction or construction of the valve seat, the smaller internal angle á plays a part for the flow pattern of the fluid. If in fact one changes the front or lower or smaller angle á, then one changes the passage speed of the fluid. Tests have shown that a favourable embodiment functions well when the angle á lies between 8 ø and 30 ø, preferably between 10 ø and 25 ø. This observed favourable embodiment permits the transport of 1.5 litres of fluid in 5 seconds, in another embodiment even in 4.2 seconds.

It is, in addition, advantageous according to the invention if inside the free space between the valve seat and the front outer edge of the mouthpiece an annular separation edge is arranged. This is formed by two surfaces set approximately at 90 ø against each other, such that the separation edge is annular. It preferably lies in an approximately horizontal plane, i.e. transversely to the longitudinal axis of the mouthpiece; and namely at the level which separates the front cylindrical part of the free space from the rear crowned part. This annular edge provides for the separation of the outflowing fluid. Thereby, the cylindrical space lying furthest to the front is no longer critical with regard to spray effect and the like.

The invention is additionally advantageously constructed in that the external diameter of the thickened part of the closure body is larger than the external diameter of the front cylinder and both external diameters are larger than the external diameter of the rear cylinder. With the valve according to the invention, it has been found that the external diameter of the front cylinder cooperates both with the outlet cross-section of the fluid on the valve seat and also with the laminator. Thus, for example, the external diameter of the front cylinder can be reduced not too greatly, because otherwise the annular outlet surface would be too small for the fluid. On the other hand, the said diameter is limited by the laminator, i.e. the diameter of the flow ducts to greater values, because the greater the external diameter of the front cylinder, the smaller the area of the total of the cross-sectional areas of the flow ducts becomes.

In a valve selected by way of example, 47 mm were selected as external diameter of the thickened central part of the closure body. Its function consists in receiving the fluid supplied in radial manner above the closure body in the space around the rear cylinder and to divide the fluid there uniformly via the inlet surfaces of the individual flow ducts. The circular line resulting at this level represents the rear or back end of the laminator region, where as it were an upper laminator edge is produced. In operation, even with a rearwardly drawn up closure body, this should not come to lie behind or above the inlet edge, which represents the lower edge or front edge of the feed pipe. In the closed state of the valve, therefore the upper laminator edge should lie by a stroke length in front of or below the inlet edge of the feed pipe.

Through the selection of the external diameters of the three parts of the closure body in the manner recommended above, the new valve operates very well, i.e. in the rear part adjacent to the rear cylinder, the fluid is collected and supplied uniformly to the flow ducts, in the flow ducts in the thickened central part of the closure body the elimination of the radial component of the flow takes place, and adjacent to the front cylinder, the outflowing fluid is calmed.

In a preferred embodiment in which the diameter of the flow ducts amounts to between 5 and 7 mm, the length of the thickened part of the closure body is approximately 1.5 times its external diameter. On taking this teaching into account, the specialist can construct a favourably operating valve without time-consuming selection processes.

It has proved to be favourable in addition here if the diameter of the ports amounts to approximately one tenth of the axial length of the thickened part of the closure body. In fact, the tendency basically exists of making the axial length of the thickened central part of the closure body so as to be as large as possible. However, this is a desire which is practically unable to be realized, because one can not form the laminator region so as to be unrestrictedly long through the construction and the design of the overall device and hence also of the housing. Thus, for example, such a length must remain for the clamping region that the fluid can flow calmly around the front cylinder and the flow pattern can continue to be calmed. For the laminator, it has been found that its external diameter, i.e. that of the thickened central part of the closure body, is to be smaller than its length.

With careful consideration of the closure body and its design, the result for the specialist is also that the external diameter of the front cylinder must not be greater than the internal diameter of the ring of ports.

The external diameter of the rear cylinder can therefore be smaller than that of the front cylinder, because in the rear region around the rear cylinder, not like at the front, a valve seat and hence an outflow cross-section is formed.

Advantageously, the specialist can construct the valve further in that according to the invention the length of the thickened central part of the closure body is greater than the length of the front cylinder. In this development, a length of the flow ducts is achieved through which the individual fluid jets emerging from the ports combine and can unite into a single jet below at the front. This combined jet can then flow out around the front cylinder of the closure cone and to the front around the valve cone in calmed form (flow pattern).

Through the arrangement of the valve seat at a distance below the thickened central part of the closure body, when the valve is closed the entire space situated under the valve sat is emptied and constructed with suitable means, some of which are described above, freely against dripping. In the region of the laminator, i.e. in the region of the flow ducts, special care no longer needs to be taken as to the surface tension of the respective fluid. In the thickened central part of the closure body, a laminating effect merely takes place, followed by a calming region below at the front. These favourable operating characteristics are achieved by flow ducts with a relatively large diameter compared with known valves. Fruit juices can also be filled in a dosaged manner with the new valve without spraying and dripping. The flow ducts in the central thickened part of the closure body can be produced by milling and boring without a great manufacturing expenditure.

Figure 2:
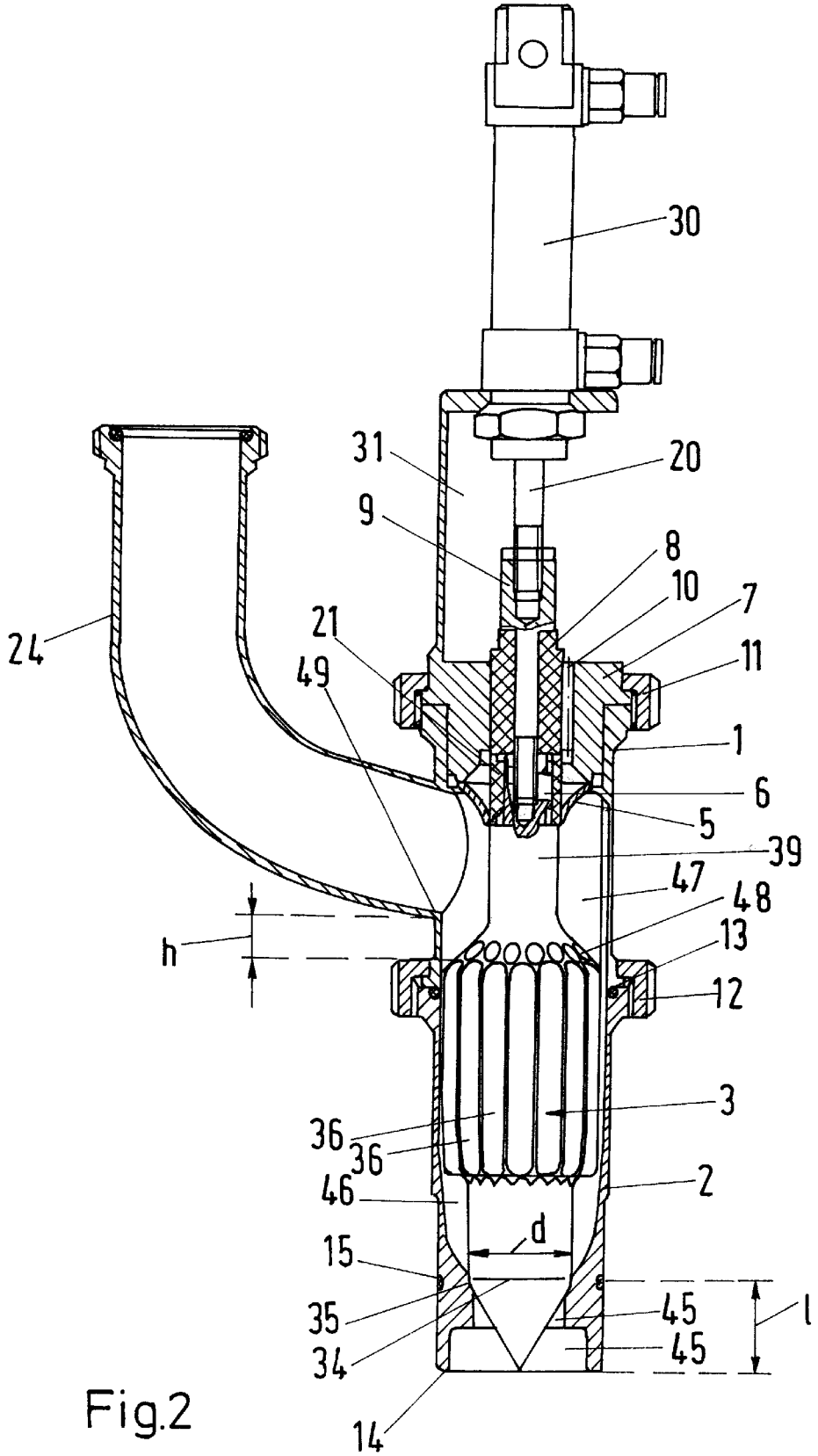
Figure 3:
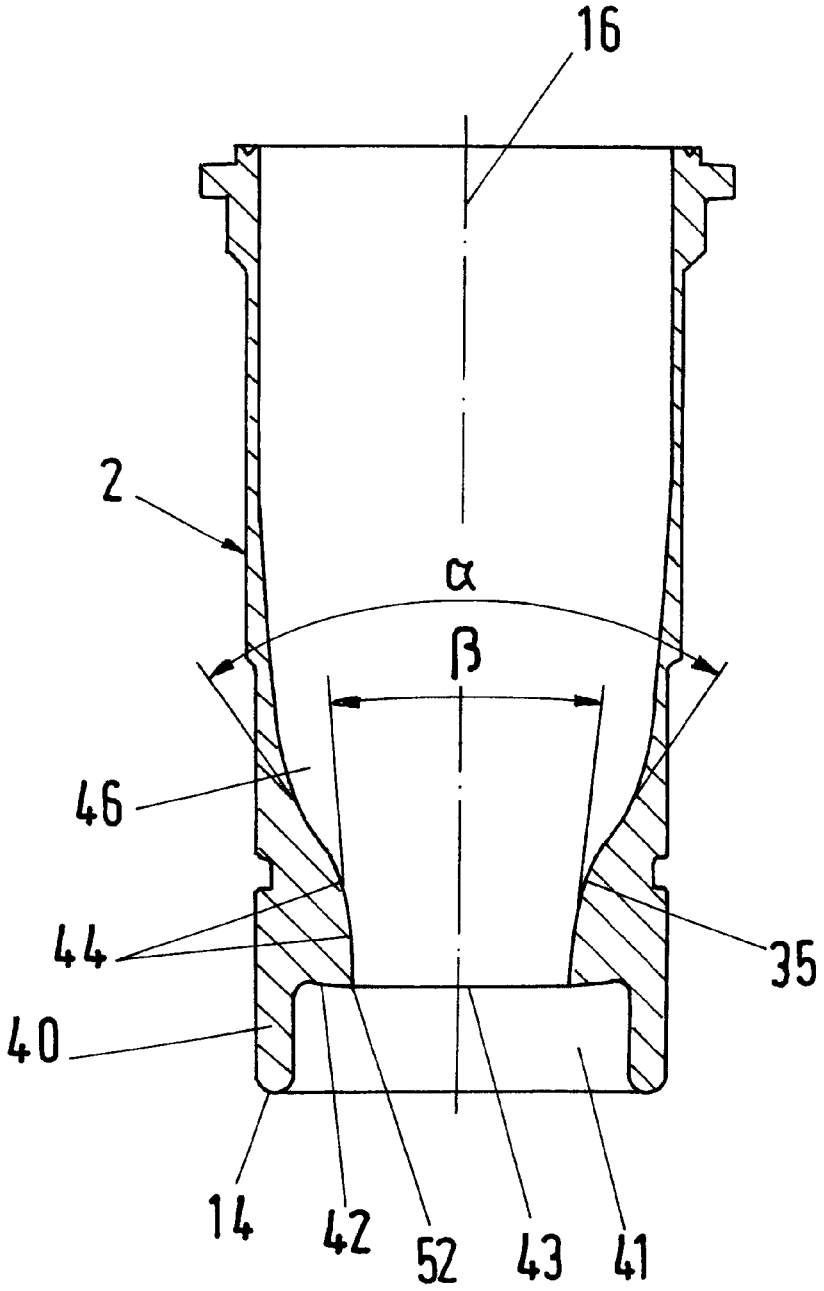
Figure 4:
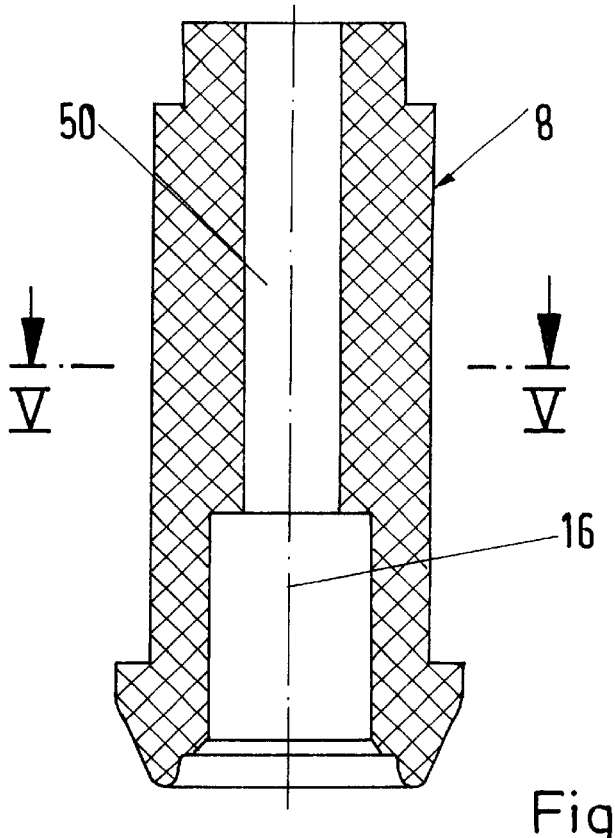
Figure 5:
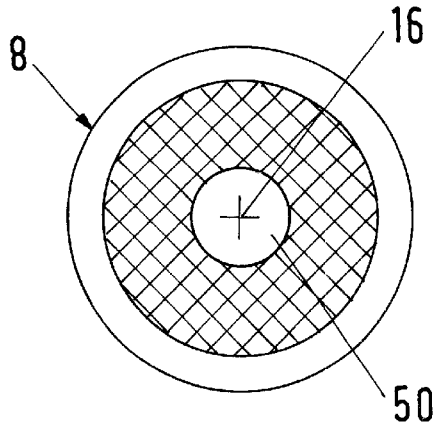
Figure 6:
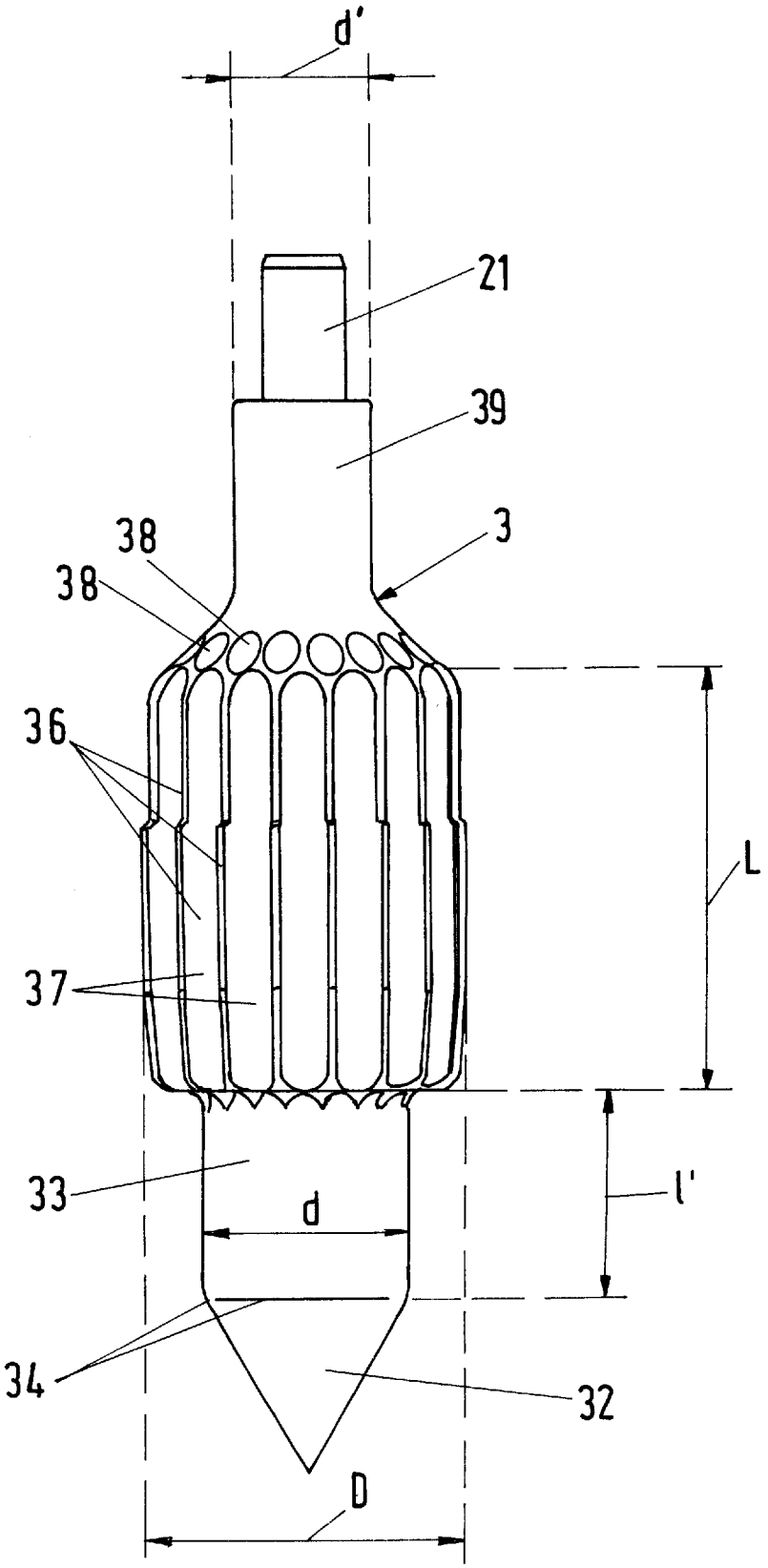
Figure 7:
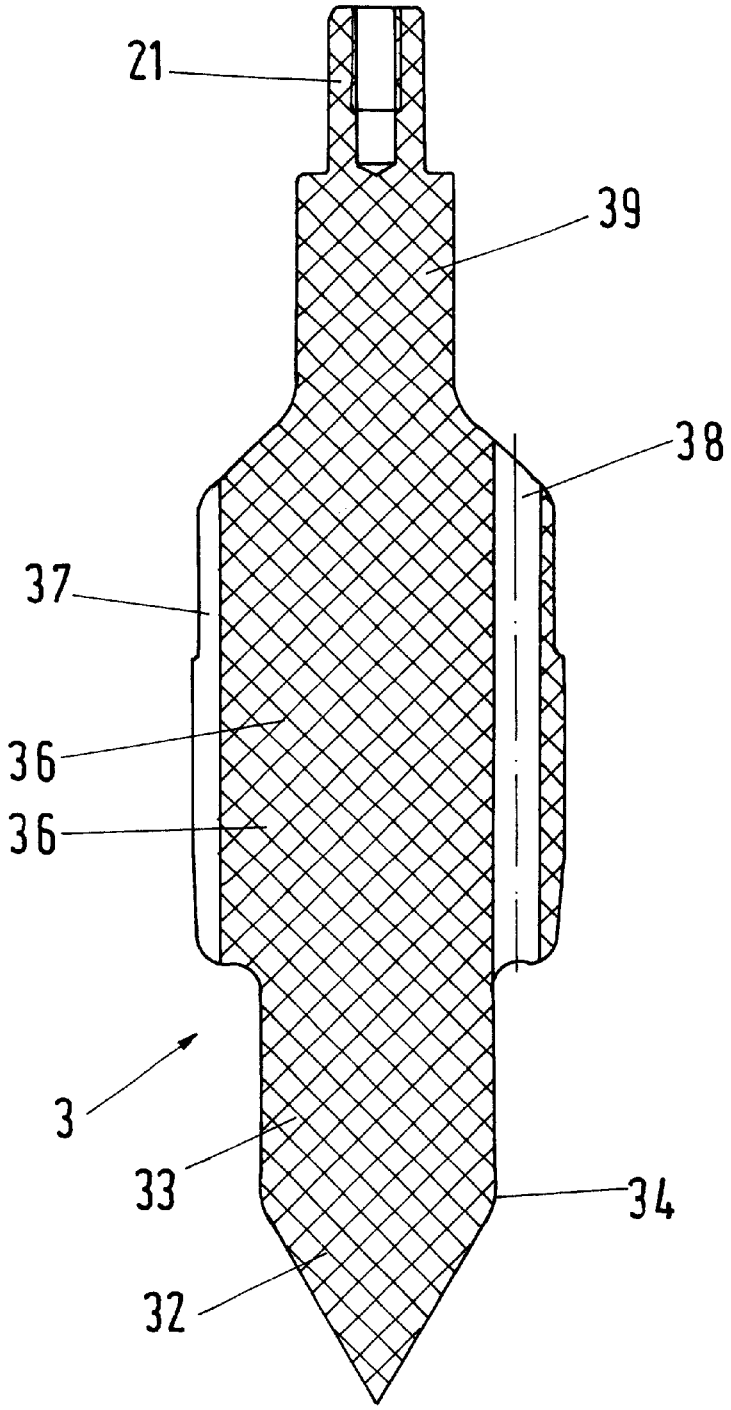
Figure 8:
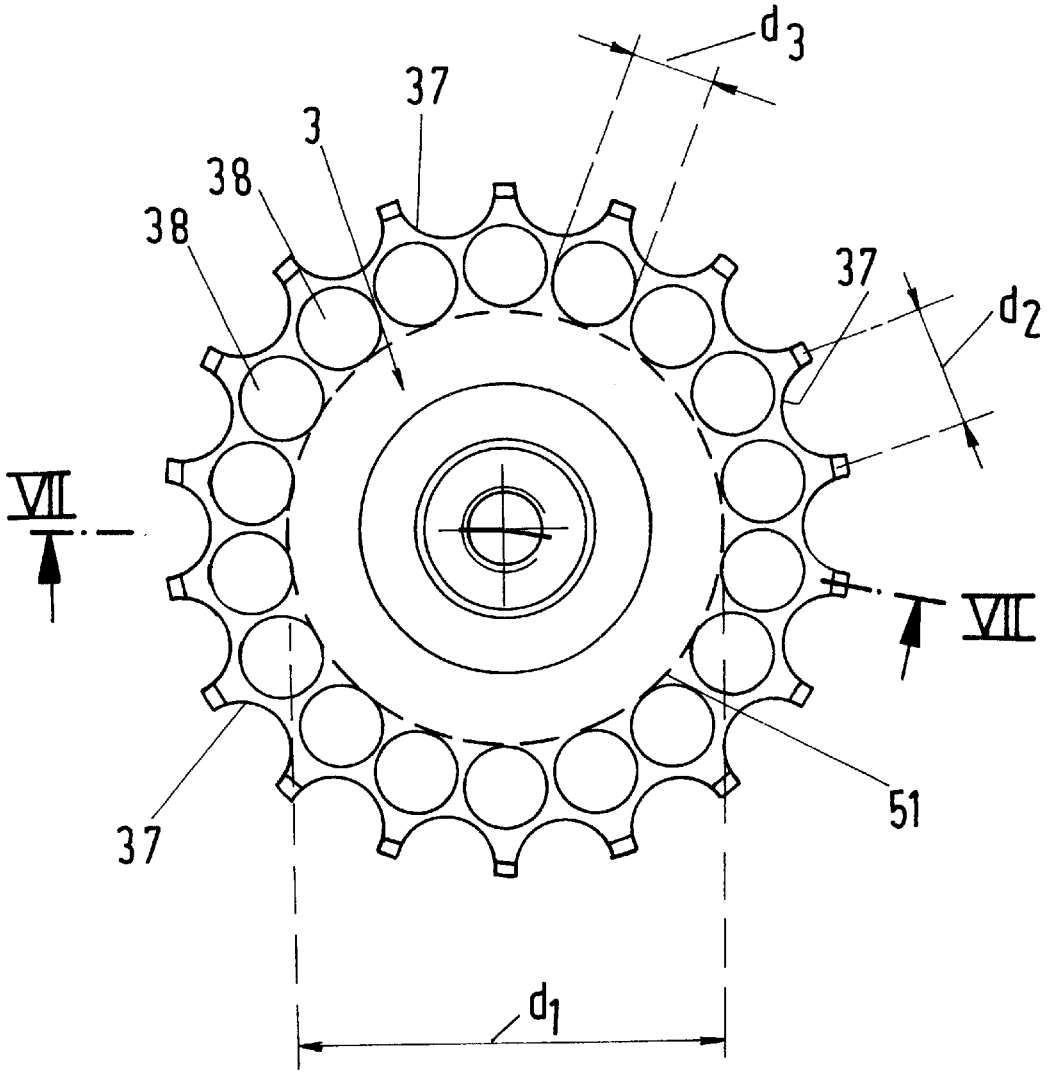

Further advantages, features and possibilities of use of the present invention will be apparent from the following description in connection with the attached drawings of a preferred embodiment, in which:

FIG. 1 shows in perspective the new filling valve without piping and without a carrier plate, in closed state, for clearer illustration with externally broken-off housing and mouthpiece, FIG. 2 shows a vertically made cross-sectional view for the filling valve in the construction of FIG. 1, FIG. 3 shows a vertical cross-sectional view of the mouthpiece in dismantled state, FIG. 4 shows a vertical cross-sectional view of the slide piece arranged on the rear face and over the sealing devices, FIG. 5 shows a horizontal cross-sectional view of the slide piece of FIG. 4 along the line V—V of FIG. 4, FIG. 6 shows the side view of the closure body in dismantled state, FIG. 7 shows a vertical cross-sectional view of the closure body along the line VII—VII of FIG. 6, and FIG. 8 shows on an enlarged scale the top view onto the closure body of FIG. 6.

On the semicylindrical upper part 31, open towards the side, of a holder 7 connected therewith and arranged there beneath, a pneumatic cylinder 30 with piston rod 20 is fastened. On the front side or at the bottom the piston rod 20 is screwed with a screw 9 which projects through a slide piece 8 and at the same time is screwed from the rear face with the shoulder 21 of the closure body generally designated by 3 so that thereby the slide piece 8 is firmly connected with the closure body 3.

The housing 1 embraces the holder 7, on which housing 1 a mouthpiece 2 is arranged at the bottom. The latter is described hereinbelow in greater detail in connection with FIG. 3. Shown in dotted lines in this and also in FIG. 4 is the longitudinal axis 16 which coincides with the longitudinal axis of the mouthpiece 2. In the direction of this longitudinal axis, the closure body 3 is arranged so as to be moveable up and down perpendicularly in the direction of the double arrow 26, driven by the pneumatic cylinder 30. A feed pipe 24 opens laterally at the top in the housing 1, where the upper rear part of the closure body 3 is situated. The latter is sealed by means of a membrane 5 of rubber or silicone.

In the extension 21 at the rear end of the closure body 3, an adjusting spring 6 sits, which secures against rotation in the groove of the slide piece 8 which is not shown. The slide piece 8 provides for a sliding movement in the bore of the holder 7. The holder 7 is screwed with a nut 11 with the housing 1. A similar nut 12 connects the housing 1 with the mouthpiece 2 where an O-ring 13 is clamped therebetween, the seat of which is constructed according to aseptic considerations. Thereby the housing 1 and the mouthpiece 2 are connected with each other in a sealed manner.

On the outer surface of the mouthpiece 2, in its lower region (lower third adjacent to the front outer edge 14 of the mouthpiece 2) there is an O-ring 15 which seals the valve against a hygiene space or sterile region of a filling machine arranged externally at the bottom for example.

The assembly is arranged so that the slide piece 8 is inserted into the holder 7. The closure body 3 is then inserted from below with the turned-over membrane 5, constructed so as to be rotationally symmetrical and in a beaker shape to the top, the adjusting spring 6 then already being placed into the groove. The extension 21 at the rear end of the closure body 3 now projects upwards into a corresponding central recess of the slide piece 8 and is screwed with the lower part of the screw 9, after which the connection with the piston rod 20 and the pneumatic drive cylinder 30 takes place at the top. With the screwing by means of the coupling nut 11 the membrane 5 could rotate and therefore one can look from below into the housing 1 and check whether the membrane 5 is placed correctly. If the membrane 5 sits exactly and in the desired position, then the mouthpiece 2 is screwed on from below. The air above and to the rear behind the membrane 5 can escape upwards through the gap 10 on the slide piece 8, so that no vacuum or excess pressure can occur in the space behind the membrane 5.

The closure body 3 has at its lower or front end a valve cone 32 at the expanded rear end of which the front cylinder 33 adjoins. The transition region, i.e. the ring area between the valve cone 32 and the front cylinder 33 is the actual sealing surface 34 which can lie against the valve seat 35. In the example embodiment shown here, the sealing surface 34 lies with closure of the valve on the valve seat 35. A thickened central part 36 of the closure body 3 adjoins the front cylinder 33 to the rear and upwards, in the peripheral region of which closure body 3 flow grooves 37 and ports 38 are situated. The latter (37 and 38) lie parallel to each other and in the form of a closed ring at small distances adjacent to each other and are open towards the front at the bottom and towards the rear and above such that in operation the fluid can flow from top to bottom. Adjoining the rear end of the thickened central part 36 is the rear cylinder 39 which is connected at its rear upper end with the extension 21, if necessary is in one piece therewith.

The mouthpiece 2 illustrated in FIGS. 1 to 3 can be seen more clearly with the aid of FIG. 3. One can see from the front to the rear or below to the top the front outer edge 14 of the mouthpiece 2 which is the foremost part of the entire valve and over which also the point of the valve cone 32 does not project forward. Towards the rear behind the front outer edge 14, the annular outer wall 40 spreads an expanded cylindrical space 41 which is limited to the rear by an annular shoulder 42 and a central, circular round opening 43. Through this central opening 43, according to the illustration of FIGS. 1 and 2, the valve cone 32 projects towards the front.

Further towards the rear, the central opening 43 is limited by a surface 44 which is constructed in crowned form, which opens in the front lower region at an angle $\beta=10°$ to $25°$ upwards towards the rear so that the curvature increases towards the rear until approximately the region of the valve seat 35 is reached. From there on the outer surface parts at a larger angle á of approximately 70°, in order to then create, with opposite curvature, the transition to the inner wall of the mouthpiece 2 approximately in the form of a cylinder covering surface.

Through these surfaces, constructed in the manner described above, in connection with the closure body 3 according to the illustration in FIGS. 1 and 2 at the front in front of and outside the valve seat 35 a free space 45 is produced, the length 1 of which is shown in FIG. 2. Towards the rear above the valve seat 35 in the mouthpiece 2 the front interior 46 is formed, which is formed externally from the inner wall of the mouthpiece 2, which opens at the large angle á of approximately 70 ø and then runs upwards with reverse curvature—on the one hand; and the outer surface of the front cylinder 33—on the other hand.

In the region of the thickened central part 36 of the closure body 3, the space formed by the housing 1 and the mouthpiece 2 is substantially filled. Towards the rear from this thickened central part 36 to the top, a likewise annular rear interior 47 adjoins, which is connected directly with the feed pipe 24. The position of the upper laminator edge 48 which defines the inlet area of the flow ducts 37, 38 is to be noted in this connection. This upper laminator edge 48 is in fact also not to be able to be moved further rearwards than the stroke length h (FIG. 2) when the valve is opened, when the sealing surface 34 has lifted completely from the valve seat 35, namely not beyond the inlet edge 49 of the feed pipe 24. If, in other words, the valve is opened as far as possible, i.e. the closure body 3 is drawn back as far as possible upwards, the upper laminator edge 48 is situated approximately at the height of the inlet edge 49 of the feed pipe 24.

In FIGS. 4 and 5, the slide piece 8 is illustrated dismantled. One can see the central duct 50 which extends in the direction of the longitudinal axis 16 of the entire arrangement in constructed state, which coincides with the longitudinal axis of the mouthpiece 2. At the bottom to the front this central duct 50 widens to receive the extension 21, as can be best seen from FIGS. 1 and 2. The slide piece 8 can preferably consist of a material, such as for example PEEK, an ester concrete with good sliding characteristics.

The closure body 3 can also consist of PEEK because this material can be processed very well, is wear-resistant and in the case of a sealing seat, it cuts in. However, one can also produce the closure body from high-grade steel.

FIGS. 6 to 8 permit an extensive illustration and description of the closure body 3. One can see there the sections described above and some of their dimensions. Thus, for example, the diameter of the front cylinder 33 is designated by d, the diameter of the thickened central part 36 is designated by D and the diameter of the rear cylinder 39 is designated by d'. These diameters are external diameters.

The length of the thickened central part is designated by L in FIG. 6, the length of the front cylinder 33 is designated by l'.

In FIG. 8 the internal diameter of the inner dotted circle 51 to the ring of ports 38 viewed in axial top view in the direction of the longitudinal axis 16, is designated by $d_1$. In the same view according to FIG. 8 the opening width (which is somewhat smaller than the diameter) of the flow groove 37 is designated by $d_2$. Finally, $d_3$ designates the diameter of a port 38.

In FIG. 3 the annular edge between the front shoulder 42 and the annular separation edge 52 formed on the annular inner surface 44 is shown.

LIST OF REFERENCE NUMBERS

1 housing
2 mouthpieces
3 closure body
5 membrane
6 adjusting spring
7 holder
8 slide pieces
9 screw
10 gap
11 nut
12 nut
14 front outer edge
15 O-ring
16 longitudinal axis
20 piston rod
21 extension
24 feed pipe
26 double arrow
30 pneumatic cylinder
31 semicylindrical upper part of the holder
32 valve cone
33 front cylinder
34 sealing surface
35 valve seat
36 thickened central part
37 flow grooves
38 ports
39 rear cylinder
40 annular outer wall
41 cylindrical space
42 ring shoulder
43 central opening
44 crowned surface
45 free space
46 front interior
47 rear interior
48 upper laminator edge
49 inlet edge of the feed pipe
50 central duct
51 inner circle of ports
52 separation edge
D external diameter of the thickened central part
d external diameter of the front cylinder
d' external diameter of the rear cylinder
L length of the thickened central part
l length of the free space
l' length of the front cylinder
$d_1$ internal diameter of the circle 51
$d_2$ internal diameter of the flow groove
$d_3$ internal diameter of the port

What is claimed is:

1. A valve for the dosaged filling of fluids in packages, with a housing (1) with feed pipe (24), mouthpiece (2) on the front face and outlet device (14), with a closure body (3) driven so as to be movable in the housing (1), able to be brought into engagement with a valve seat (35) and having a valve cone (32) at the front and also therebehind a thickened central part, and with rear sealing devices (5), characterised in that the thickened central part (36) of the closure body (3) is provided on its peripheral region with a ring of flow ducts (37, 38) extending in the direction of the longitudinal axis (16) of the mouthpiece (2), which flow ducts (37, 38), which are open toward the front and toward the rear, open into the interior (46, 47) formed by the housing (1).

2. The valve according to claim 1, characterised in that the closure body (3) has a front cylinder (33) between the valve cone (32) at the front and the central part (36), and also has a rear cylinder (39) between the central part (36) and the rear sealing devices (5).

3. The valve according to claim 1, characterised in that the flow ducts (37, 38) are formed by flow grooves (37) arranged on the periphery of the central part (36) of the closure body (3) and open radially to the exterior, and/or by radially closed ports (38).

4. The valve according to claim 1, characterised in that the sealing surface (34) situated in the transition region between the valve cone (32) and front cylinder (33) is able to be brought into engagement with the valve seat (35) in the mouthpiece (2) and the valve cone (32) projects into a free space (45) between valve seat (35) and front outer edge (14) of the mouthpiece (3).

5. The valve according to claim 1, characterized in that the free space (45) between the valve seat (35) and the front outer edge (14) of the mouthpiece (2) in its rear region which lies on a quarter to two thirds of the axial length (1) in front of the valve seat (35), is formed by a surface (44) which is constructed so as to be crowned in cross-section.

6. The valve according to claim 1, characterised in that at the front end of the free space (45) between valve seat (35) and front outer edge (14) of the mouthpiece (2) an annular separation edge (52) is arranged.

7. The valve according to one of claim 1, characterised in that the external diameter (D) of the thickened central part (36) of the closure body (3) is greater than the external diameter (d) of the front cylinder (33) and both external diameters (D, d) are greater than the external diameter (d') of the rear cylinder (39).

8. The valve according to claim 1, characterised in that the length (L) of the thickened central part (36) of the closure body (3) amounts to approximately 1.5 times its external diameter (D).

9. The valve according to claim 1, characterised in that the diameter (d3) of the ports (38) amounts to approximately one tenth of the axial length (L) of the thickened central part (36) of the closure body (3).

10. The valve according to claim 1, characterised in that the length (L) of the thickened part (36) of the closure body (3) is greater than the length (l') of the front cylinder (33).

* * * * *